United States Patent [19]

Briscoe

[11] 3,968,871

[45] July 13, 1976

[54] SAFETY CONTAINER FOR MEDICINE BOTTLES AND THE LIKE

[76] Inventor: Woodrow H. Briscoe, General Delivery, Cowichan Bay, British Columbia, Canada, VoR 1N0

[22] Filed: May 16, 1975

[21] Appl. No.: 578,145

[52] U.S. Cl. ..... 206/1.5; 215/221
[51] Int. Cl.[2] ..... A45C 13/10; A45C 13/18
[58] Field of Search ..... 215/221, 9, 224, 225; 206/1.5, 530, 807; 220/8

[56] References Cited

UNITED STATES PATENTS

| | | | |
|---|---|---|---|
| 3,200,979 | 8/1965 | Powers | 215/221 |
| 3,844,407 | 10/1974 | Brie | 206/1.5 |

*Primary Examiner*—George T. Hall
*Attorney, Agent, or Firm*—Fetherstonhaugh & Co.

[57] ABSTRACT

A container is provided with a base attachable and lockable to a capped medicine or other bottle. The base is telescopically fitted with a top having an opening aligned with the cap on the bottle. A strong spring urges the top away from the base so that normally the cap is spaced below the opening. Only a considerable amount of compressive force calculated to be exertable only by an adult will telescope the container against the resistance offered by the spring to project the cap through the opening to a position where the cap can be unscrewed and the contents of the bottle removed.

6 Claims, 6 Drawing Figures

SAFETY CONTAINER FOR MEDICINE BOTTLES AND THE LIKE

My invention relates to means for safeguarding the contents of a medicine bottle and more particularly to a container or a pill bottle or the like which will prevent most children from gaining access.

There have been a number of devices suggested which are intended to seal a medicine bottle in such a way that an inquisitive child cannot obtain aspirin, for example, and perhaps eat them as he would candy with distressing results. Some of these devices are quite elaborate in form and, therefore, are costly to purchase, which perhaps explains why they are not used as extensively as they should be in the home. Others are not foolproof enough to foil an ingenious child or, alternatively, are so complex in their operation as to exasperate many adults trying to operate them as required.

I overcome the above, as well as other disadvantages of conventional bottle guards, by providing a container which is simply and inexpensively constructed as well as being extremely easy to operate. The container relies on the known resistance to compression of a spring to foil attempts to unscrew the bottle cap. The amount of compression required is beyond the strength of most children below a selected age and only a reasonably strong adult can gain access to the bottle contents.

One embodiment of the invention comprises simply a container having a member which can be inserted over the top of a medicine bottle fitted with a cap, said member having an upper wall provided with an opening through which the cap can pass, spring means biasing the member away from the upper portion of the bottle, and stop means limiting movement of the member relative to the bottle in response to pressure applied by the spring means normally to maintain the cap a predetermined distance from the opening in the upper wall.

More specifically, a device according to the present invention may be defined as a safety container for medicine bottles or the like which comprises a base member adapted to receive a medicine bottle fitted with a cap, locking means securing the base member to the bottle, a top member enclosing an upper portion of the medicine bottle and being telescopically mounted with respect to the base member, said top member having an opening normally positioned above the cap and through which said cap can pass, spring means biasing the top member away from the base member, and stop means limiting extension of the members beyond a closed position of the container wherein the cap normally is inoperable through the opening in the top member.

Figure 1:
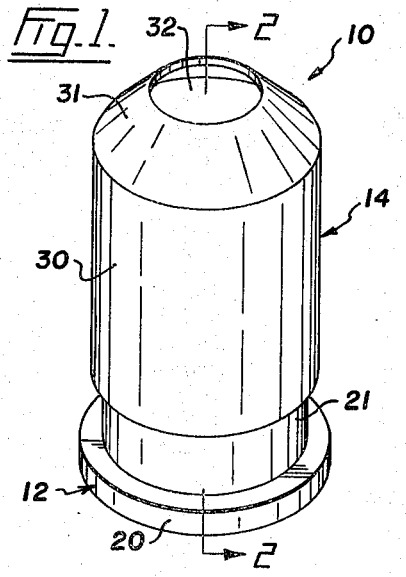
Figure 2:
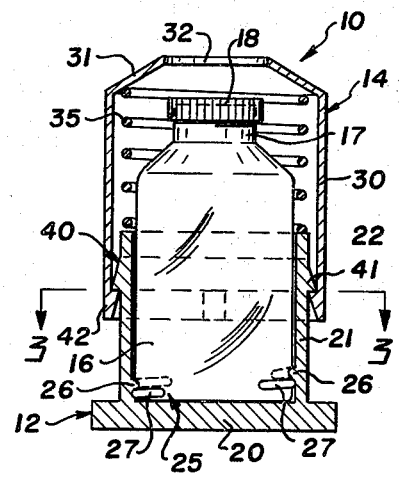
Figure 3:
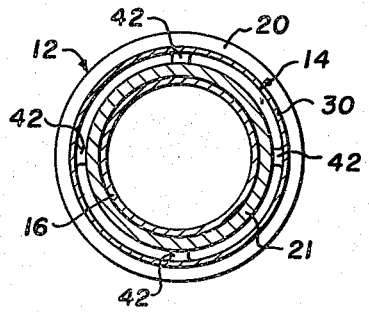
Figure 4:
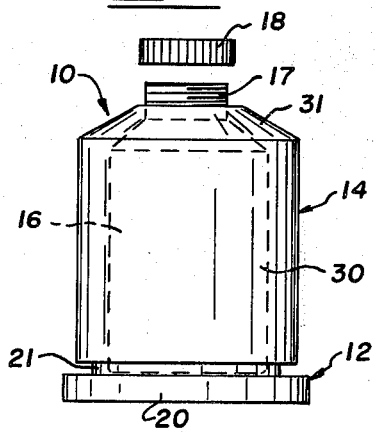
Figure 6:
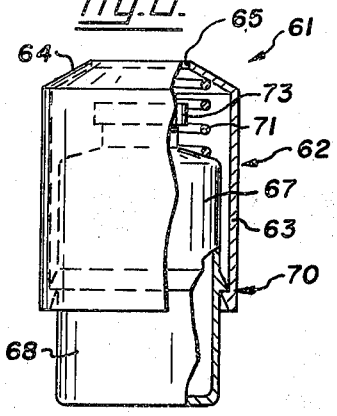
Figure 5:
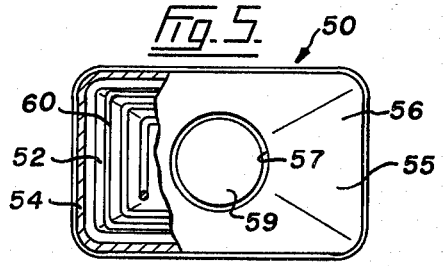

In drawings which illustrate a preferred embodiment of the invention,

FIG. 1 is a perspective view of a safety container,

FIG. 2 is an enlarged vertical section of the container taken on the line 2—2 of FIG. 1, FIG. 3 is a horizontal section of the container taken on the line 3—3 of FIG. 2, FIG. 4 is a side elevation showing the container in open position with the bottle cap removed to dispense the contents, FIG. 5 is a plan view, part broken away and shown in section, illustrating a modified safety container, and FIG. 6 is a side elevation, also partly broken away and shown in section of still another embodiment of the invention.

Referring to the drawings, the numeral 10 indicates generally a safety container having a base member 12 and a top member 14, both of which I prefer to make of a tough plastic which is highly resistant to cutting or tearing.

As shown best in FIG. 2, a container 10 encloses a bottle 16 of the type which might contain pills or some other medicine likely to be toxic if taken in excessive amounts especially by children. The medicine bottle 16 may be cylinderical as illustrated or be of any other cross-sectional shape, but this particular bottle has a neck 17 fitted with a screw-threaded cap 18.

The base member generally indicated at 12 is shown best in FIG. 2 to comprise a bottom wall 20 and a cylindrical side wall 21 which terminates in an upper edge 22 spaced from the neck 17. The bottle 16 is a fairly snug fit within the side wall 21 and the base member 12 is locked to the bottle by means generally indicated at 25. Locking means 25 is shown to comprise a pair of diametrically opposed lugs 26 which are formed on the inner surface of the wall 21 near the wall 20. These helically-wound lugs 26 are adapted to be engaged by similar thread-like lugs 27 formed on the outer surface of the bottle near its bottom wall. Thus, the medicine bottle 16 can be inserted into the base member 12 and given a partial turn to interlock the two parts. The plastic used to construct the member 12 has a natural tendency to cling to the bottle whether it be of glass, plastic or metal so that, once they are secured together by the locking means 25, they cannot be separated except by considerable force usually requiring a tool of some kind.

The top member generally indicated at 14 has a cylindrical side wall 30 slightly larger and thinner than the side wall 21 of the base member 12. A dome-like upper wall 31 is intregally formed with the wall 30 and the former wall is provided with a central opening 32 which is aligned with and of slightly greated diameter than the cap 18 on the medicine bottle.

The members 12 and 14, which are telescopically arranged, are urged apart by a strong compression spring 35. Preferably, spring 35 sits on the upper edge 22 of the base member to bear against the underside of the inclined upper wall 31 of the top member.

Stop means, generally indicated at 40, is provided to prevent complete separation of the members 12 and 14. As shown in FIGS. 2 and 3, the means 40 comprises a tapered flange 41 which is formed on the side wall 21 of the base member 12 a short distance below the upper edge 22. The remainder of the stop means 40 consist of reversely tapered dogs 42 which project inwardly from the inner surface of the side wall 30 and which are circumferentially spaced therearound. These dogs 42 are adapted to engage with the flange 41. The relatively thin and slightly flexible plastic top member 14 is sized with respect to the base member 12 so that it can be pressed into engagement therewith. As the top member 14 is pushed downwardly over the side wall 21 of the base member, the dogs 42 ride over the flange 41 and the side wall 30 is distorted or sprung sufficiently so that the dogs and flange can interengage as shown in FIG. 2. Spring 35 then exerts a strong force which keeps the member 12 and 14 in their fully extended or closed position of a container at which time the cap 18 on the medicine bottle is disposed an appropriate distance below the opening 32 and is inaccessible to the fingers of anyone trying to obtain the pills or whatever from the bottle. In order to gain access to the cap 18, the telescopic members 12 and 14 must be compressed as shown in FIG. 4 and, to do so, requires strength not possessed by a small child. The average adult, however, has the weight and/or strength to overcome the force of the compression spring 35 and to hold the container closed when the cap has been projected through the opening 32 so as to be operable by the fingers. The cap 18 can then be unscrewed, the required dosage removed from the bottle, and the cap can be replaced whereupon the container can be allowed to snap to the closed position.

From the foregoing, it will be apparent that the present container will serve to keep aspirin as well as other poisonous or injurious substances out of the reach of nearly all children who will lack the strength or ingenuity to open the container to the extent of being able to unscrew the cap. Most adults however, will have little or no trouble in opening the device in the manner described to gain access to the contents of the bottle. When the bottle is empty, it can be removed and be replaced with a full bottle of similar manufacture. This is done by springing the dogs 42 out of engagement with flange 41 to permit removal of the top member 14. The empty bottle is then unscrewed and is replaced by the full bottle with sufficient turning force being applied to the latter bottle so that the underside thereof will frictionally grip the top surface of the wall 20 of the base member. This frictional engagement plus the interlocking of the lugs 26 and 27 secures a bottle to the base member whereupon the spring and member 14 can be re-assembled so that the container is again ready for use.

Referring now to FIG. 5, there is shown a safety container 50 which is adapted to be fitted to a substantially oblong medicine bottle 52. The container 50 has base member 54 and a top member 55 suitably shaped to conform to the shape of the bottle, the top member having an upper wall 56 provided with an opening 57 which is normally spaced above a cap 59 on the bottle. A spring 60 urges the top member 55 away from the base member 54 as in the case of the preferred embodiment of the invention and otherwise the container 50 is provided with suitable locking means and stop means (neither shown) which serve the same purpose a the corresponding parts of the container 10.

In operation; the container 50 functions as previously described, viz., a small child cannot exert a force great enough to compress the spring 60 which must be done before the cap 59 can be projected through the opening 57 to a position where the cap can be unscrewed or otherwise removed. An adult, however, can compress and hold the container to obtain relatively easy access to the contents of the bottle.

The FIG. 6 embodiment of the invention is a safety container 61 which has a top member 62 provided with a cylindrical side wall 63 and an upper wall 64. An opening 65 is formed in the wall 64. The wall 63 is adapted to fit over an upper portion 67 of a medicine bottle 68 and stop means 70 similar to the one previously described secures the container against movement longitudinally of the bottle in one direction. A spring 71 is interposed between the wall 64 of the container and the bottle normally to keep the stop means 70 engaged and to space a cap 73 which is fitted to the bottle, suitable distance below the opening 65 in the upper wall of the member 62.

The simply and inexpensively constructed container 61 operates substantially in the previously described manner to safeguard the medicine or the like contained in the bottle 68.

What I claim is:

1. A container comprising a member insertable over an upper portion of a medicine bottle fitted with a cap, said member having an upper wall provided with an opening through which the cap can pass, spring means biasing the member away from the upper portion of the bottle, and stop means limiting movement of the member relative to the bottle in response to pressure applied by the spring means normally to maintain the cap a predetermined distance from the opening in the upper wall.

2. A container comprising a base member adapted to receive a medicine bottle fitted with a cap, locking means securing the base member to the bottle, a top member enclosing an upper portion of the medicine bottle and being telescopically mounted with respect to the base member, said top member having an opening normally positioned above the cap and through which said cap can pass, spring means biasing the top member away from the base member, and stop means limiting extension of the members beyond a closed position of the container wherein thc cap normally is inoperable through the opening in the top member.

3. A container as claimed in claim 2, in which said locking means comprises helically-wound lugs on the base member and the medicine bottle adapted to threadedly engage one another whereby said member and bottle are frictionally held against separation.

4. A container as claimed in claim 2, in which said stop means comprising a tapered flange on one of said members and tapered dogs on the other of said members, at least one of said members being distortable to permit the lugs to traverse the inclined flange in one direction.

5. A container as claimed in claim 2, in which both said base member and said top member are made of a plastic material.

6. A container comprising a base member having a bottom wall and a side wall, said base member being adapted to receive a medicine bottle seated on the bottom wall of a partially enclosed by the side wall, locking means securing the medicine bottle against separation from the base member, a top member having a side wall enclosing upper portions of the medicine bottle and the base member, said top member having an upper wall provided with an opening through which a cap on the medicine bottle can be projected by telescoping the members to an open position of the container, spring means biasing the top member away from the base member to a closed position of the container wherein the cap is disposed below the opening, said spring means offering a predetermined high resistance to opening movement of the container, and stop means limiting movement of the top member away from the base member.

* * * * *